US012595705B2

(12) United States Patent
Abdelkader et al.

(10) Patent No.: US 12,595,705 B2
(45) Date of Patent: Apr. 7, 2026

(54) CONTINUOUS MEASUREMENT GAUGE WEAR DEVICE WHILE DRILLING

(71) Applicant: KING ABDULLAH UNIVERSITY OF SCIENCE AND TECHNOLOGY, Thuwal (SA)

(72) Inventors: Ahmed Galal Mahmoud Abdelkader, New Cairo (EG); Shehab Ahmed, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 89 days.

(21) Appl. No.: 18/691,936

(22) PCT Filed: Sep. 13, 2022

(86) PCT No.: PCT/IB2022/058622
§ 371 (c)(1),
(2) Date: Mar. 14, 2024

(87) PCT Pub. No.: WO2023/042075
PCT Pub. Date: Mar. 23, 2023

(65) Prior Publication Data

US 2025/0129674 A1 Apr. 24, 2025

Related U.S. Application Data

(60) Provisional application No. 63/243,881, filed on Sep. 14, 2021.

(51) Int. Cl.

| | |
|---|---|
| ***E21B 12/02*** | (2006.01) |
| ***E21B 47/013*** | (2012.01) |
| ***E21B 47/017*** | (2012.01) |

(52) U.S. Cl.
CPC ..... *E21B 12/02* (2013.01); *E21B 47/013* (2020.05); *E21B 47/017* (2020.05)

(58) Field of Classification Search
CPC ..... E21B 12/02; E21B 47/017; E21B 47/013
See application file for complete search history.

(56) References Cited

U.S. PATENT DOCUMENTS

| | | |
|---|---|---|
| 2,461,164 A | 2/1949 | Farral |
| 2,468,905 A | 5/1949 | Warren, Jr. |

(Continued)

FOREIGN PATENT DOCUMENTS

WO 9928590 A1 6/1999

OTHER PUBLICATIONS

International Search Report in corresponding/related International Application No. PCT/IB2022/058622, date of mailing Nov. 30, 2022.

(Continued)

*Primary Examiner* — Shane Bomar
(74) *Attorney, Agent, or Firm* — PATENT PORTFOLIO BUILDERS PLLC

(57) ABSTRACT

A continuous wear measuring device for measuring a wear in a well tool includes a probe configured to wear simultaneously with the well tool, and a control unit electrically connected to the probe and configured to continuously measure a parameter of the probe. The control unit is configured to map a measured value of the parameter to a wear amount of the well tool.

20 Claims, 15 Drawing Sheets

(56) References Cited

U.S. PATENT DOCUMENTS

| | | | | |
|---|---|---|---|---|
| 2,580,860 | A | 1/1952 | Stokes | |
| 2,582,312 | A | 1/1952 | Daniel | |
| 2,657,909 | A | 11/1953 | Bielstein | |
| 3,363,702 | A | 1/1968 | Bielstein | |
| 4,785,895 | A | 11/1988 | Davis, Jr. et al. | |
| 6,167,833 | B1 | 1/2001 | Caraway et al. | |
| 6,250,295 | B1 | 6/2001 | Chanton et al. | |
| 2004/0000401 | A1* | 1/2004 | Sale | G01V 5/125 166/254.2 |
| 2010/0139987 | A1 | 6/2010 | Hunt et al. | |
| 2012/0325564 | A1 | 12/2012 | Vaughn et al. | |
| 2016/0153244 | A1* | 6/2016 | Humphrey | E21B 10/56 175/39 |
| 2019/0292896 | A1* | 9/2019 | Costa de Oliveira | E21B 47/08 |
| 2019/0352973 | A1* | 11/2019 | Sehsah | E21B 47/12 |
| 2020/0157910 | A1 | 5/2020 | Sehsah et al. | |
| 2020/0332652 | A1* | 10/2020 | Sehsah | E21B 47/01 |
| 2021/0131268 | A1* | 5/2021 | Rahmani | E21B 10/16 |
| 2021/0363871 | A1* | 11/2021 | Samuel | E21B 44/00 |
| 2022/0025714 | A1* | 1/2022 | Moellendick | E21B 12/02 |
| 2022/0243537 | A1* | 8/2022 | Kanyanta | B23B 27/20 |
| 2022/0268146 | A1* | 8/2022 | Zhan | E21B 47/017 |
| 2022/0282609 | A1* | 9/2022 | Samuel | E21B 47/002 |
| 2023/0012069 | A1* | 1/2023 | Kruspe | E21B 12/02 |
| 2023/0175394 | A1* | 6/2023 | Zhan | E21B 47/13 175/40 |

OTHER PUBLICATIONS

Written Opinion of the International Searching Authority in corresponding/related International Application No. PCT/IB2022/058622, date of mailing Nov. 30, 2022.

* cited by examiner

CONTINUOUS MEASUREMENT GAUGE WEAR DEVICE WHILE DRILLING

CROSS-REFERENCE TO RELATED APPLICATIONS

This application is a U.S. National Stage Application of International Application No. PCT/IB2022/058622, filed on Sep. 13, 2022, which claims priority to U.S. Provisional Patent Application No. 63/243,881, filed on Sep. 14, 2021, entitled "CONTINUOUS DRILLING TOOLS GAUGE WEAR LOGGING WHILE DRILLING," the disclosures of which are incorporated herein by reference in their entirety.

BACKGROUND

Technical Field

Embodiments of the subject matter disclosed herein generally relate to a drilling system and method for drilling, and more particularly, to a continuous gauge measuring device that can be attached to downhole drilling bits or associated tools and the device is capable of continuously logging the amount of wear experienced by the drilling bit or tool while drilling.

Discussion of the Background

Drilling for accessing an underground reservoir (e.g., oil or gas) takes place on land or offshore, at the ocean bottom. This process is a very complex process that requires utilization of various tools and devices for making the well, stabilizing the well, and then extracting the resources from the reservoir through the well. FIG. 1 depicts a land drilling system 100. Although an offshore drilling system is more complicated than the land drilling system, they share the same drilling mechanism and thus, some of the problems associated with the system shown FIG. 1 are similar for offshore drilling. The drilling system 100 includes a drill rig 102 located above the ground's surface 104, and a part located in the subsurface 106, under the ground's surface 104. The drill rig 102 is configured to provide the necessary energy for the drilling process, i.e., for the lifting and rotation actions involved in this process. The drill rig 102 supports a drill string 108 that partially extends into the well 110 that is being drilled. The drill string 108 is made of a series of strings (pipes) connected to each other and is utilized to transmit the necessary rotational energy and drilling fluids downhole.

The drill string 108 is made of two sections, the drill pipes 112 and the bottom hole assembly (BHA) 114. The drill pipes 112 are pipes that provide means of connecting the BHA to the drill rig 102 on the surface, and also for providing mud for removing the drilled pieces (debris) from the bottom of the well. The BHA 114 includes a plurality of tools that performs the actual drilling process. The BHA may include, for example, a drill collar 116, which provides the required weight for the drill bit 118 to cut through the formation. Additional drilling tools 120 may include any other tool to assist the drill bit 118 perform its task or to enlarge the hole.

Various types of drill bits 118 exist today for creating the well and each of them utilizes a different technique to drill through the formation. No matter which technique is used, when drilling through hard abrasive rocks in the formations, the drill bits tend to wear out. The amount of wear experienced by the drill bit or drilling tools is affected by different factors including, but not limited to, the subsurface formation being drilled, rate of drilling (rate of penetration), drilling parameters, drilling fluids used in the well, and whether the drilling is performed vertically or directionally. To optimize the tool life and the drilling performance, it is necessary to identify the wear patterns on the tools and also the amount of drilling left in the drill bit. In other words, as the drill bit becomes dull or worn out, it is necessary to stop the drilling process, and change the drilling bit with another one. This process may happen couple of times during the drilling of a well. However, to make this process as efficient as possible, the operator of the rig needs to know when the drill bit has run out of its drilling capabilities and needs to change it.

Different techniques have been proposed to enable the operator of the drill rig to quantify the amounts of material worn from the drill bit and wear rates experienced. Different methods have been previously utilized in the drilling domain to either quantify the wear experienced by the drill bit after drilling is completed or to inform and notify the operator of the drill rig that severe wear is currently affecting the drill bit and thus, the drill bit has to be pulled out of well.

The most common method suggested by many drill bit operators is to provide an indication to the operator at the surface that the bit has reached a specific volume of wear and it should be pulled out. This method was proposed in [1] for drag bits and [2] for roller cone bits. In this method, a plug is used to lock a passage of mud extending from a bit's internal cavity to an annulus. When the plug is intact, no flow passes, but as the drilling progresses and due to the wear, the plug erodes. Once the plug is totally eroded, the passage is opened, thus allowing the mud to flow through it to the annulus. The unobstructed flow of the mud through the passage causes the pressure difference across the well to drop, which could be sensed by the operator at the surface, to identify that the drill bit has reached a critical volume of wear and therefore, drilling with that drill bit should be halted.

Different versions of the above-mentioned idea have been suggested throughout the years. The authors in [3] suggested, that instead of sensing that the plug has been totally worn out by measuring the pressure drop, to utilize the plug to store behind it a radioactive liquid, which would be released to the mud flow upon a total wear of the plug. The operator then could identify that the plug is totally worn out once radioactive traces are detected in the returning mud. Another version is introduced by [4], which suggests utilizing a form of a detectable liquid rather than utilizing radioactive fluids.

Another version discussed in [5] suggests using a piston between a drill bit's internal cavity and an erodible plug. The piston would then cause a diversion in the mud flow and therefore release the flow into another cavity within the drill bit to cool the cutters before being released into the annulus. The operator would be able to identify that the drill bill has reached its limit by the drop in the pressure difference. The authors in [6] suggests an improvement of the device in [5] by using a piston supported by a spring to overcome the friction and losses within the passage.

The authors in [7] proposed the use of multiple plugs with different orifice sizes to provide information to the operator about the wear levels at different steps during the drilling process. Another concept disclosed in [8] utilizes the same idea of multiple plugs with multiple orifices, but the orifices are placed on different regions of the bit. This concept was utilized to provide to the operator information about where the wear is occurring rather than the wear levels.

All the above-mentioned methods were aimed to inform the operator of the drill that the bit had reached a specific wear volume while drilling, i.e., a discrete type of information. Other techniques aimed to provide discrete results have tried to quantify the amount of wear experienced by the bit while drilling. For example, [9] suggests utilizing a plug, but the plug is created from different layers. Each layer has a different color. As the drilling operation proceeds, parts of the plug are expected to wear. These would be collected in the mud filtration system and based on the color collected, the operator could identify the amount of wear on the drill bit. Another embodiment of the same document suggested embedding spheres of different colors in the plug. As the plug erodes, the spheres would be released in the mud flow and collected in the mud filtration system at the surface.

Another idea was disclosed in [10] and this reference suggested embedding a group of resistor circuits at different depths inside the drill bit body. This method was suggested for metal reinforced matrix bits where the bit is manufactured using molding techniques. All the circuits would then be connected to a power supply and a control unit placed within the drill bit internal cavity. As the drill bit body starts to wear, parts of the circuits would wear, opening the corresponding electrical circuit. The control unit would then detect this and either send a signal to the surface, if live communication is established with the surface, or save it on memory to be retrieved at the surface to identify the wear rates against the depth and formations being drilled.

Other existing techniques try to identify the wear rates on the drill bits. However, none of these provides continuous readings of the wear rates on the drill bit while drilling. In other words, all the existing techniques either provide an indicator once the wear of the drill bit exceeds a specific threshold value(s), or record the wear values at discrete instances. Thus, these techniques could not answer questions such as the effect of the drilling parameters on the wear rate, or the effect of the formation lithology on the wear rate or the effect of moving from one formation to another on the wear rate.

Thus, there is a need for a new wear detection device for drill bits or well tools that is capable of continuously detecting the wear of the drill bit or tool.

BRIEF SUMMARY OF THE INVENTION

According to an embodiment, there is a continuous wear measuring device for measuring a wear in a well tool. The device includes a probe configured to wear simultaneously with the well tool, and a control unit electrically connected to the probe and configured to continuously measure a parameter of the probe. The control unit is configured to map a measured value of the parameter to a wear amount of the well tool.

According to another embodiment, there is a well tool that includes a body having a blade, the blade being configured to remove material from a formation, a sensor attachment located in a cavity formed in the blade, and a continuous wear measuring device for measuring a wear in the well tool. The continuous wear measuring device is configured to attach to the sensor attachment, and the continuous wear measuring device is configured to wear simultaneously with the well tool and is configured to map a measured value of a parameter to a wear amount of the well tool.

According to yet another embodiment, there is a continuous wear measuring device kit that includes a sensor attachment having an internal, circumferential groove, and a continuous wear measuring device having an external, circumferential ridge that is sized to mate with the groove. The sensor attachment is configured to be brazed inside a hole in a well tool, and the continuous wear measuring device is configured to continuously measure a wear in the well tool as a probe of the continuous wear measuring device simultaneously wears with the well tool.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a continuous wear measuring device that includes a resistive probe that is configured to wear at the same rate as the drill bit, and also includes electronics for continuously measuring the resistance of the probe and mapping that resistance to the wear amount on the drill bill. However, the embodiments to be discussed next are not limited to a resistive probe, but may be applied to a capacitive, or inductive or a mixture of these probes.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a novel continuous wear measuring device includes a wear probe that is configured to wear as a component of the drill bit wears down, and electronics connected to the wear probe and the electronics are configured to continuously measure a parameter associated with a size of the wear probe, and to estimate, based on this measurement, how much of the probe is lost due to wear. More details about the continuous wear measuring device are now discussed with regard to the figures.

Figure 1:
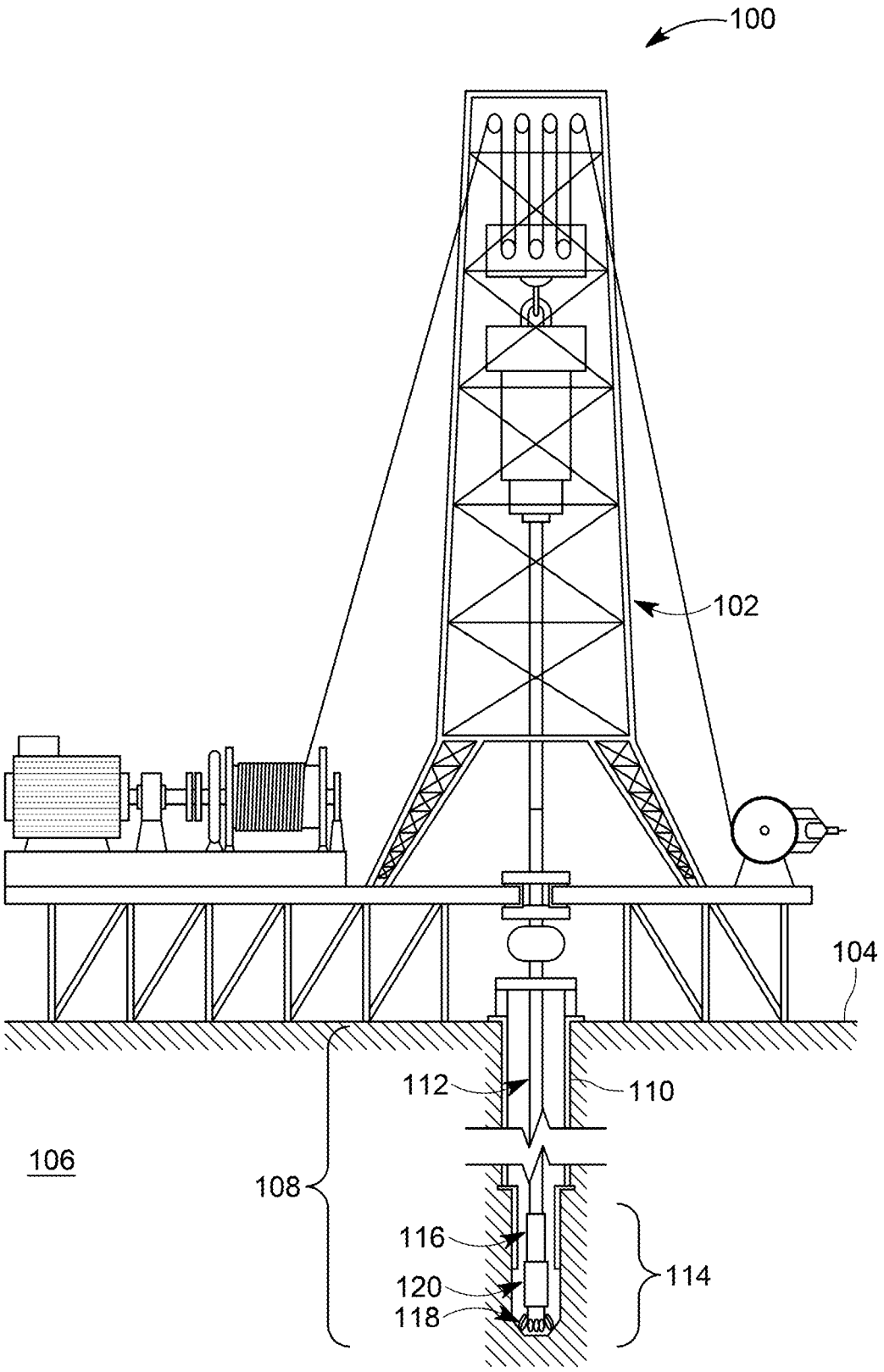
FIG. 1 is a schematic diagram of a drilling system used for making a well.
Figure 2A:
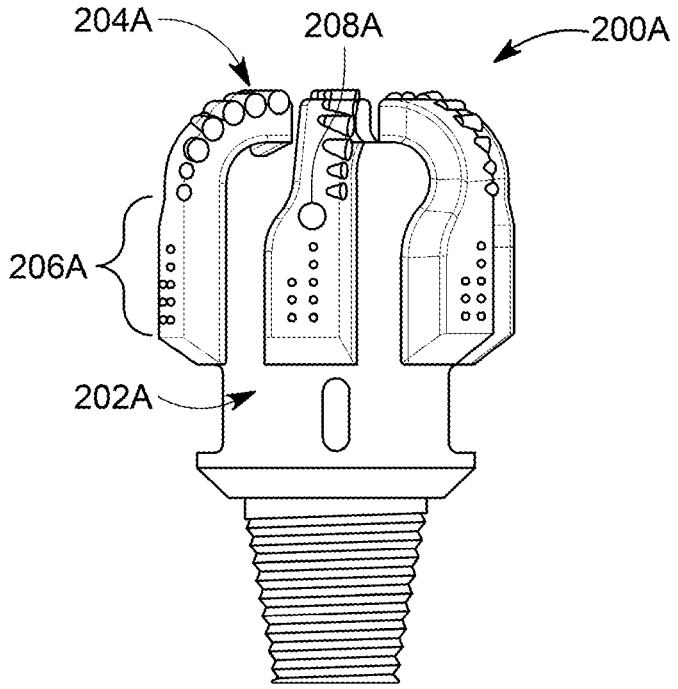
FIGS. 2A to 2C illustrate various drill bits and well tools that are used during the drilling process.
Figure 2B:
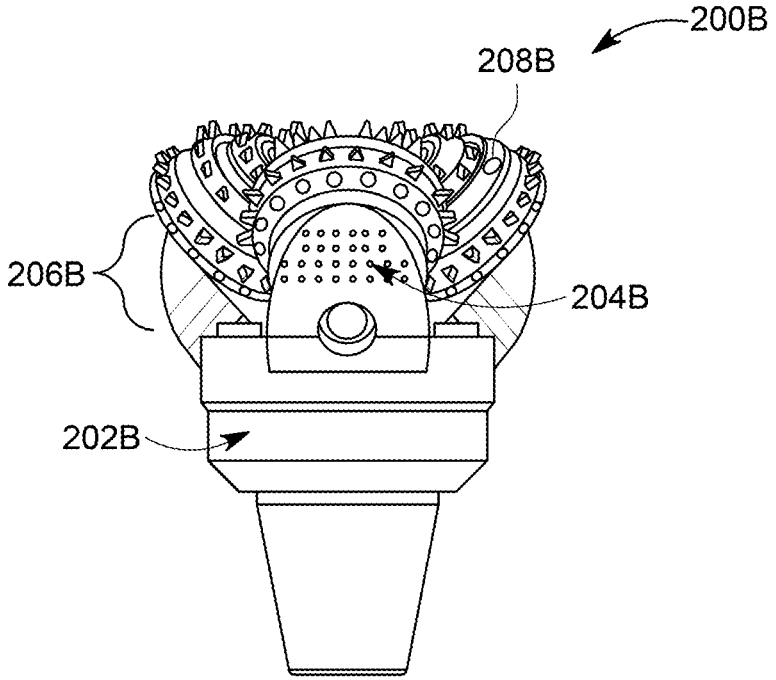
Figure 2C:
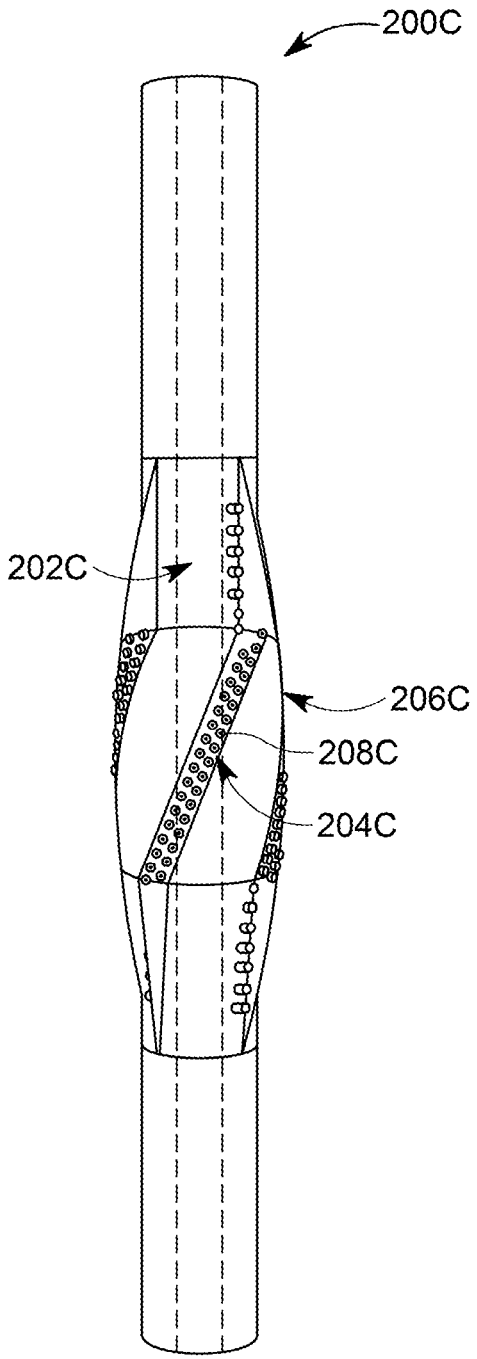

FIGS. 2A to 2C illustrate various drills bits and tools that may be utilized while drilling. For example, FIG. 2A shows a fixed blade drill bit 200A, FIG. 2B shows a roller cone drill bit 200B, and FIG. 2C shows a drilling reamer 200C. While the drill bits 200A and 200B are used in the well to drill the bottom of the well, the drilling reamer 200C is used to enlarge the diameter of the already created well. All these tools and other drilling tools, such as stabilizers, underreamers, etc. or any other drilling tool that has direct contact with the borehole of the well can be used with the continuous wear measuring device to be discussed next.

All these tools have a main body 202A, 202B, and 202C, with blades 204A and 204C for the tools 200A and 200C, and cones 204B for the tool 200B, and these blades/cones protrude out of their corresponding main bodies. On these protrusions, a section that is in direct contact with the underground formation is called the "gauge." FIGS. 2A to 2C show gauges 206A to 206C corresponding to the tools 200A to 200C, respectively. In this embodiment, the continuous sensor device is placed within corresponding cavities or chambers or holes 208A to 208C, which are made in the gauges 206 to 206C, respectively, because it is the section which wears the most due to its direct contact with the formation. In this way, the resistive (or capacitive or inductive) part of the continuous wear measuring sensor device rubs directly against the wall of the well and thus, it wears at the same rate as the drill bit or any other tool that experiences the wear process.

Figure 3:
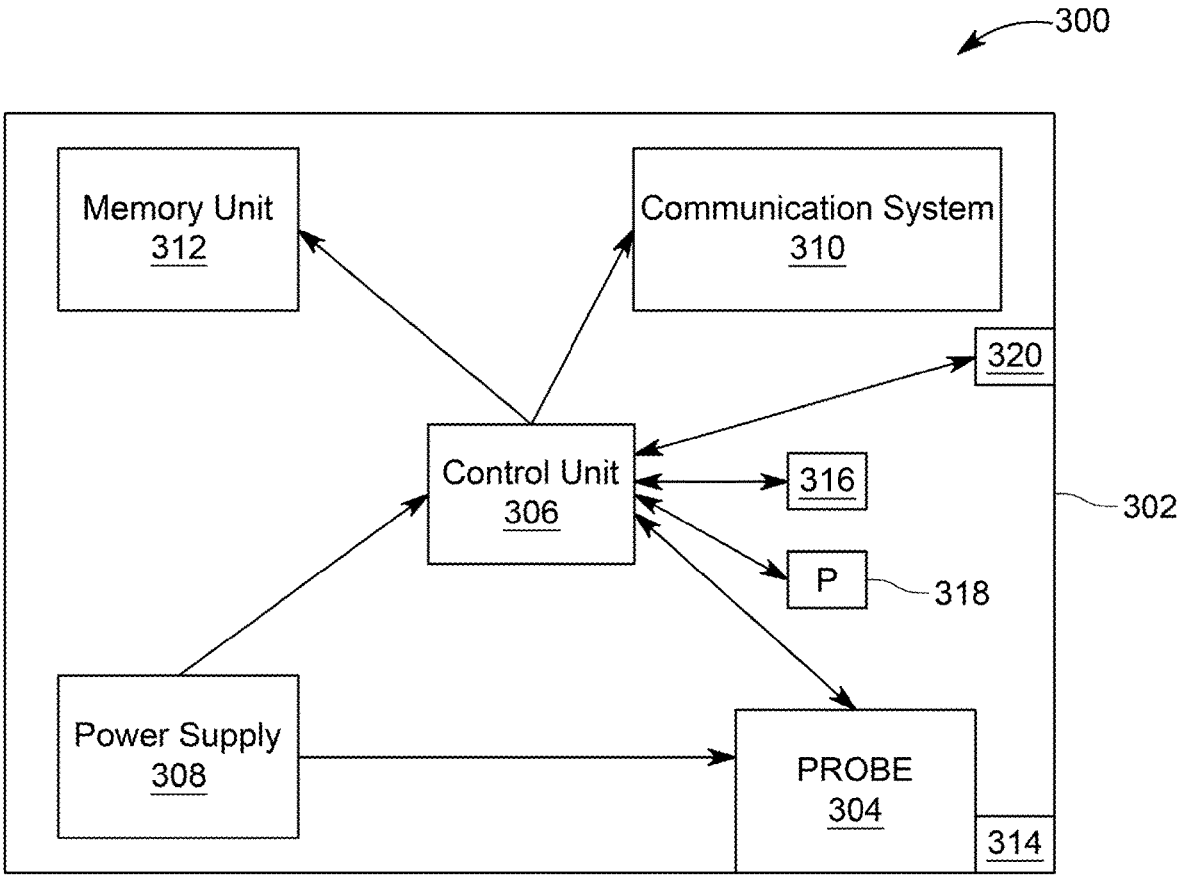
FIG. 3 is a schematic diagram of a continuous wear measuring device that is attached to a well tool.
Figure 4A:
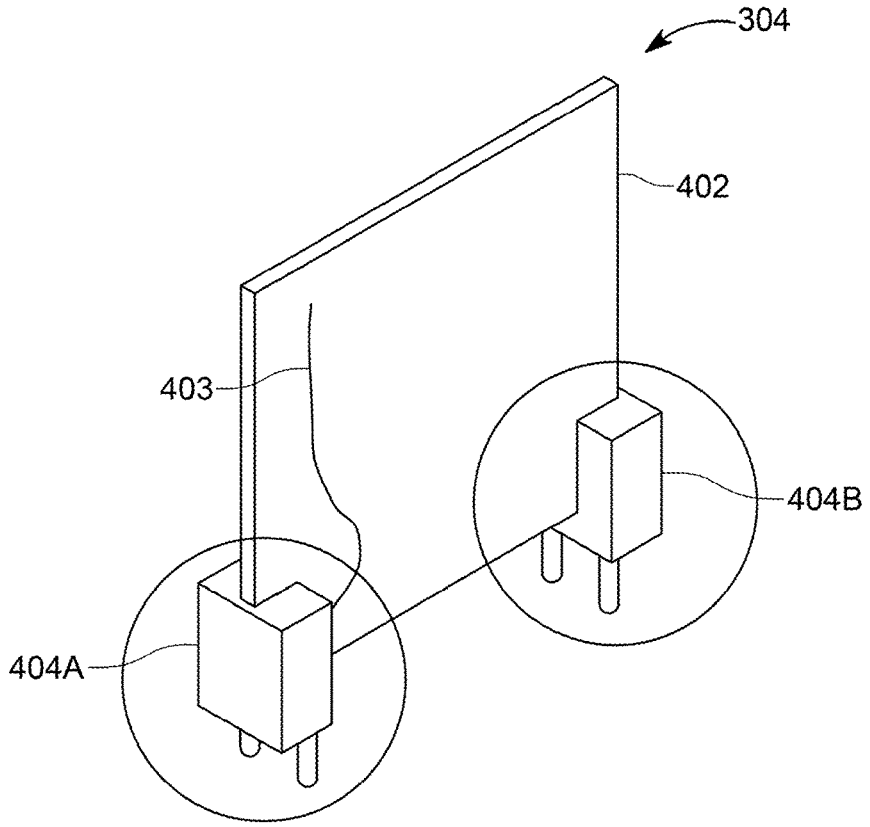
FIGS. 4A and 4B illustrate a probe part of the continuous wear measuring device that is configured to wear simultaneously with the well tool.
Figure 4B:
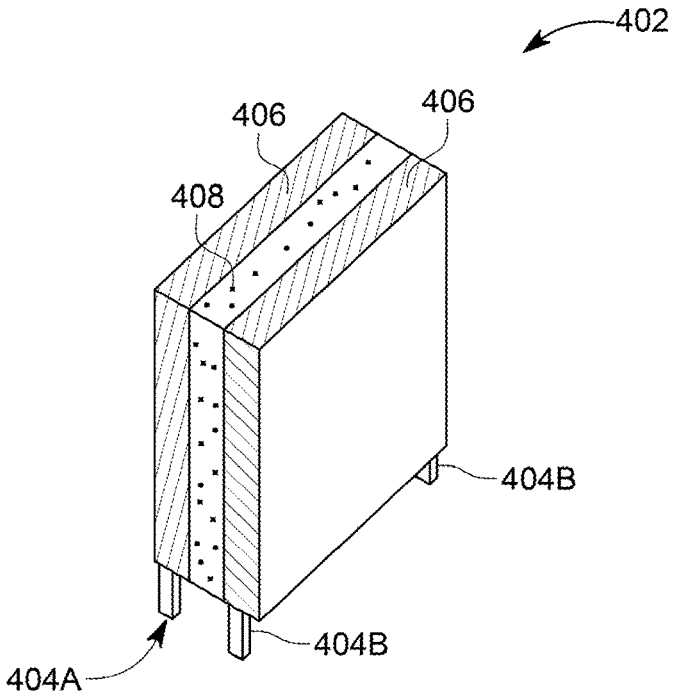

In one embodiment, as illustrated in FIG. 3, a continuous wear measuring device 300 has a housing 302 that houses a solid erodible wear probe 304, which is configured to have a measurable electrical property related to the size and/or geometry of the probe. Such a probe 304 is schematically shown in FIG. 4A and has a body 402 and a pair of pads 404A and 404B. The body 402 may be shaped in various ways. FIG. 4A shows the body 402 being shaped as a rectangular slab of metal. For this particular configuration, a resistance of the metal slab would be continuously measured by a control unit 306, which is electrically connected to the pads 404A and 404B. The control unit 306 is also housed by the housing 302, as shown in FIG. 3. In one application, the body 402 may be made of an insulator material that carries plural resistive elements 403 (only one shown for simplicity) and the resistance of these resistive elements is measured by the control unit. However, other geometrical shapes may be used for the body 402. For example, if the probe is a capacitive probe, then FIG. 4B shows the body 402 configured as a capacitor having two opposite plates 406 that sandwich a dielectric layer 408. A side of the capacitor that exposes both plates and the dielectric layer is then exposed from the body of the drill bit to wear against the formation. In this way the entire capacitance of the body 402 is affected/changed by the wearing process, and the control unit 306 is configured to continuously determine the change in capacitance, and map it to the wearing percentage or mass of the drill bit or tool.

When the probe 304 is attached to the gauge surface of the drilling tool, at least a portion of the probe body 402 is directly exposed to the well (which is schematically illustrated in FIG. 3) and thus, it is expected to erode at the same rate as the tool. This erosion of the body 402 induces a change in its geometry, which directly influences/changes an electrical property (resistance for a resistor, or capacitance for a capacitor, or inductance for an inductor or a mixture of them) of the probe. Because the change in the body 402's electrical property is proportional to the change in its geometry, a continuous measurement of the electrical property by the control unit would provide a direct indication of the amount of erosion experienced by the probe and subsequently of the body of the well tool.

If the body 402 is a resistor or holds a resistive element 403, the probe 304 is a resistive sensor. Initially, when the resistor is at its full length, its resistance is known. As the resistor is ground or worn due to the direct interaction with the formation, the length of the resistor decreases and therefore, the total resistance of the resistor increases. If the body 402 is a capacitor, because of its location in the hole 208, the three layers (two plates and one dielectric layer) erode simultaneously at the same rate as the general wear of the drilling tool gauge. Thus, any change in the geometry of the capacitor will yield a direct change in the capacitance across the capacitor, which could be directly related to the amount of wear induced on it. Any alternative electrical device with such geometrically dependent electrical property can be utilized in this embodiment.

Through calibration, a direct relationship between the electrical property (R, C, L or a combination of them) of the probe 304 and the amount of material removed (ground or worn) from it could be calculated. This relationship could be utilized to measure the depth or amount removed from the well tool, based on its electrical property, for example, based on the relationship:

$$F(R) = d$$

where R represents the electrical property of the probe 304, and d is the depth of material removed from the body 402 of the probe 304.

Returning to FIG. 4A, the pads 404A and 404B are configured to be electrically connected to the control unit 306 for sensing the wear experienced by the drilling tool or bit. As the drill bit 200A, 200B or tool 200C drills through the formation and experiences wear on its gauge, the body 402 of the probe 304 is also expected to wear at the same rate of wear as the drill bit. For this purpose, the body 402 is desired to be fabricated from a material that is strong enough to resist the loads exerted on it by the formation without failure. However, it is also desired that the body 402 is made from a material that is softer/weaker than the drill bit material.

The continuous wear measuring device 300 further includes, in addition to probe 304 and the control unit 306, a power supply 308 for powering both the probe and the control unit. The control unit 306 has two main tasks for this embodiment. The first task is to continuously measure the electrical property of the probe 304 and convert that into a depth of material removed from the probe's body, which is equivalent to the depth of wear experienced by the gauge of the drill bit or tool 200A, 200B, 200C. The control unit 306 is then required to provide this data to the operator of the drill rig. This could be achieved in real time or the data could be logged at the device 300 for later retrieval.

For real time monitoring, the control unit 306 is coupled to a data communication system 310, which may be sound, optical or electrical based system. Such system could then convert the data from the control unit into pulses to be carried through the mud in the well (sound system), or through wiring in smart pipes, or transmitted using electromagnetic waves if a transmitter/receiver module is placed within the drill string downhole. Data could be also transmitted to the surface utilizing wireless communication or through an actuated extended antenna. Any type of communication protocols between the control unit 306 and the surface is possible.

The other option is to log the measured data at a memory unit 312, at the device 300, and to retrieve this data at the surface, once the drilling is accomplished. In this case, the control unit 306 saves the data in the memory unit. Once the drilling is completed and the drill bit is pulled out of hole, the control and memory units could then be retrieved from the drill bit and analyzed to download all the data stored on the memory unit for analysis by the operator.

The power supply unit 308 is utilized to power the whole device 300. It provides power to the control unit 306 to operate the system. In one application, the power supply unit 308 may be implemented as a battery that operates the device for a specific period of time until the battery is depleted. In another application, the power supply unit may be a device that is configured to utilize a downhole power generation technique that utilizes mud to generate electricity. Another option could be to convert the vibrational energy of the drilling process to power up the system using, for example, a piezoelectric element. Any other form of powering up the system could be utilized.

Figure 5A:
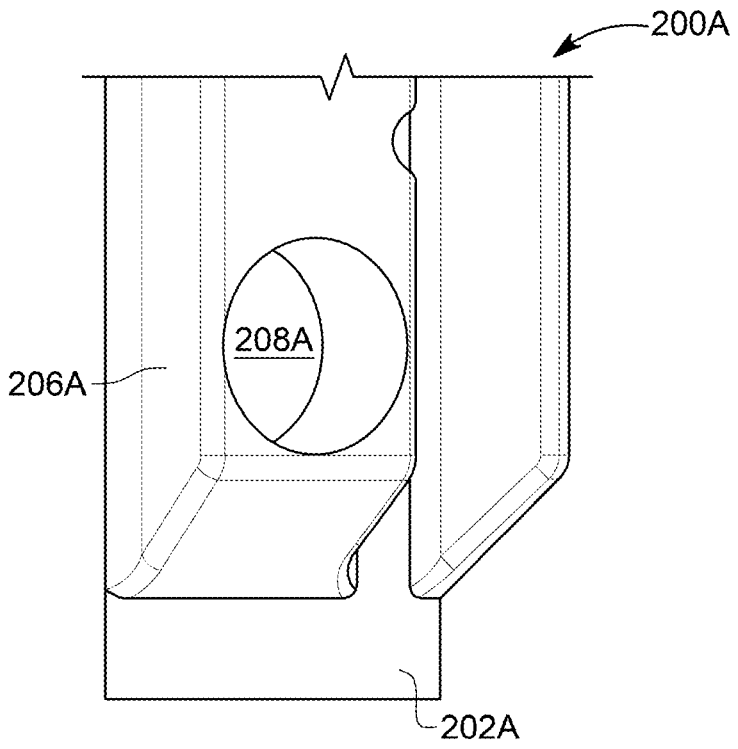
FIGS. 5A and 5B illustrate a blade of the well tool in which a hole is made to host the continuous wear measuring device.
Figure 5B:
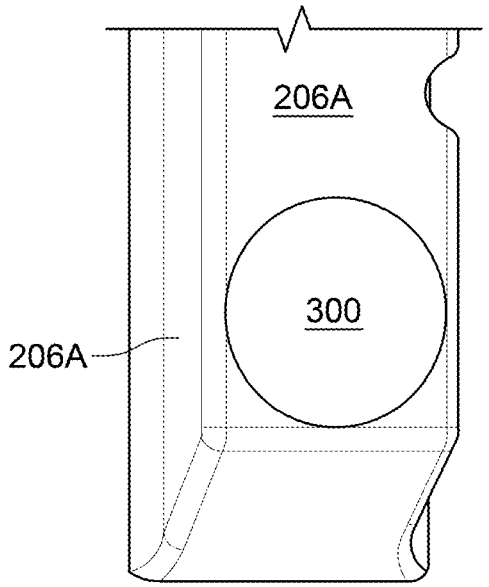

The continuous wear measuring device 300 may be added to the drill bit or tool in a specifically made cavity 208A to 208C, depending on the tool. For example, as illustrated in FIGS. 5A and 5B for the drill bit 200A, the cavity 208A is made in the gauge 206A, so that the cavity directly faces the wall (see FIG. 5B) of the well when the drill bit is placed inside the well. The cavity 208A could be created when the bit is manufactured or it could be created after the bit has been manufactured, before utilizing it. The continuous wear measuring device 300 can be fixed within the cavity 208A using fastening features such as threads, welding or brazing techniques or any other method to attach the proposed device to the cavity. The attachment technique should provide means for fixing the sensor to the drill bit body, minimize heat transfer from the bit to the device and try to isolate vibrations as much as possible. Heat and vibrations could have a negative impact on the probe and the control unit.

Figure 6:
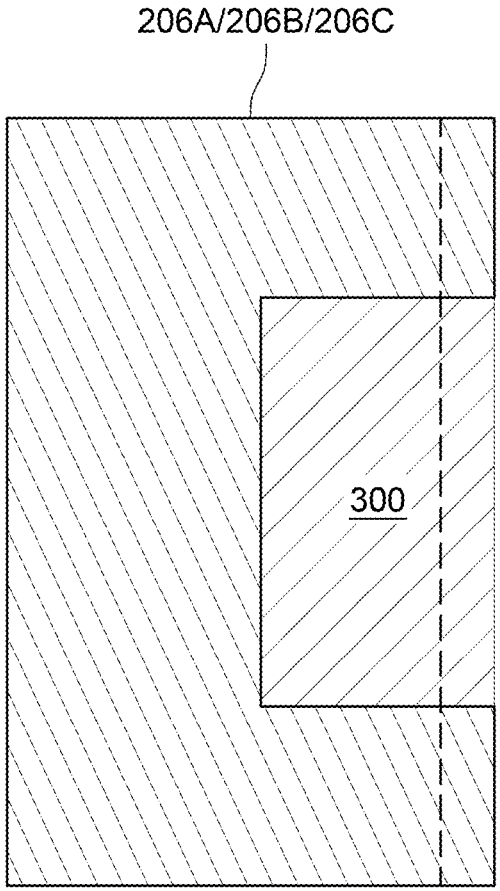
FIG. 6 illustrates how the continuous wear measuring device wears simultaneously and at the same rate as the well tool in which it is placed.
Figure 7:
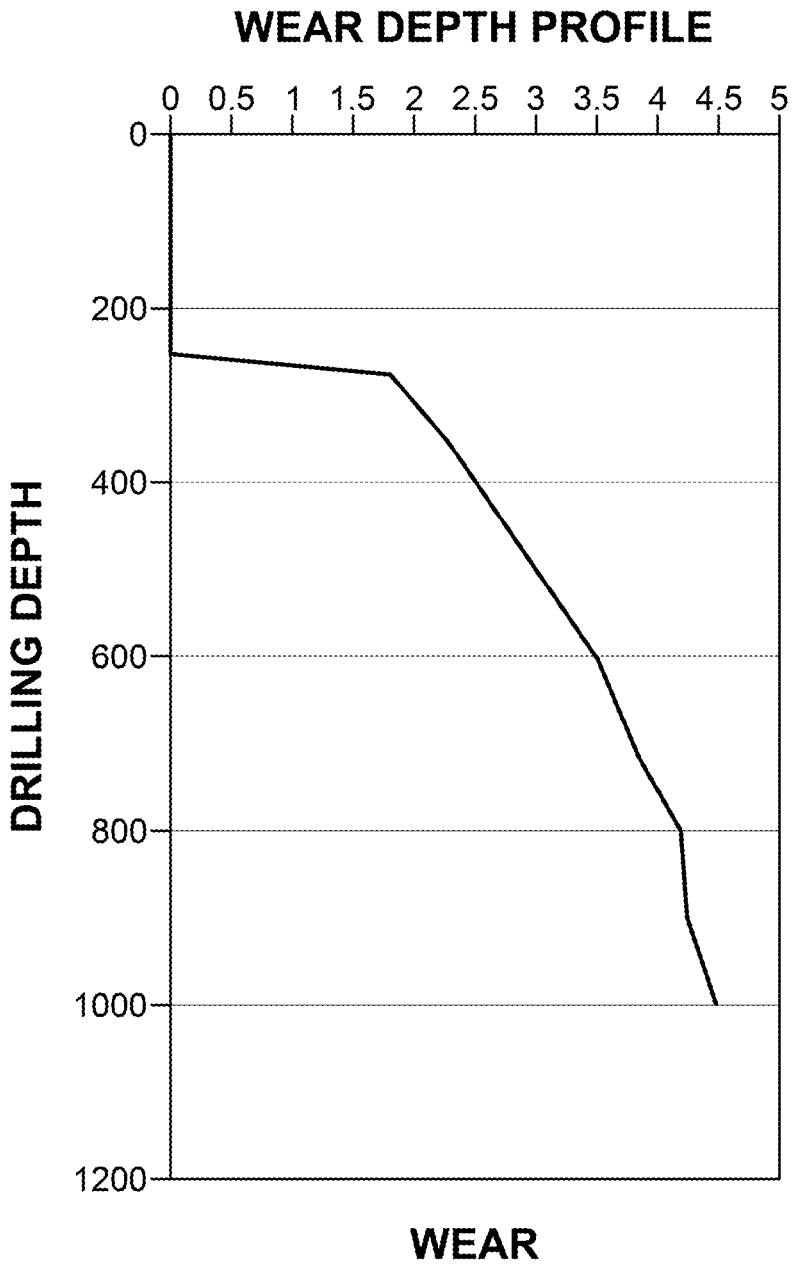
FIG. 7 illustrates the amount of wear experienced by a well tool with a depth of the well.

Once the drilling operation is commenced, the continuous wear measuring device 300 would immediately measure the electrical property of the probe 304, convert it to a wear value and either send it to the surface through the communication system 310 or store it in memory unit 312. As the drilling operation progresses, the drill bit is expected to simultaneously wear out with the same rate as the continuous wear measuring device, as shown in FIG. 6. As the drill bit wears, the body 402 of the probe 304 also wears as shown in FIG. 6. The continuous wear measuring device 300 would continue collecting the data as the well progresses to show the amount of wear occurring on the drill bit based on the amount of wear experienced by the probe, as illustrated in FIG. 7.

The data retrieved from the proposed continuous wear measuring device 300, whether through live communication or through the data logger, could be analyzed by the operator of the rig to provide various information. The data is provided as the depth of wear measured at fixed time intervals or depth intervals as shown in FIG. 7. This shows the amount of wear experienced by the drill bit or tool at any time during the drilling process. From the drilling logs, this could be utilized to generate an indicative figure of the amount of wear experienced by the drill bit at any depth during drilling, which could then indicate the amount of wear experienced by the bit in each formation lithology drilled. The data could be differentiated with respect to time to identify the wear rates at any time/any depth while drilling. The data could clearly indicate the wear rate in different lithologies and in transition sections when drilling between two different lithologies. A direct relationship can then be established between the wear rate and the type of rock present in the well. Note that knowing the lithologies present in the well is very helpful during oil recovery as different muds or liquids are used to extract/pump the oil or to frack the formations to further release the oil.

The proposed device 300 could also be coupled with a set of other sensors to improve the quality of the data collected and/or transmitted to the surface. A temperature sensor 314 (see FIG. 3) could be added to notify the operator about the temperature at the drill bit while drilling. This data could be utilized to identify the effect of temperature of the wear and wear rates experienced by the drill bit. Another embodiment may have an accelerometer 316 present inside the housing 302 to identify vibrations during drilling. This could also be utilized to study whether the magnitude and frequency of the vibrations have effects on the wear on the drill bit. Other sensors could be also added to the device 300, such as pressure transducers 318, or chemical sensors 320 (partially exposed to the embodiment) to measure a concentration of any chemicals that are present downhole, such as hydrogen sulfide $H_2S$, which is a very harmful compound emitted occasionally from the formation while drilling. All this information may be used to study and correlate the ambient conditions with the wear on the drill bit. Thus, the proposed device 300 provides an innovative method to continuously measure and report the amount of wear experienced on the drill bit while drilling.

Figure 8:
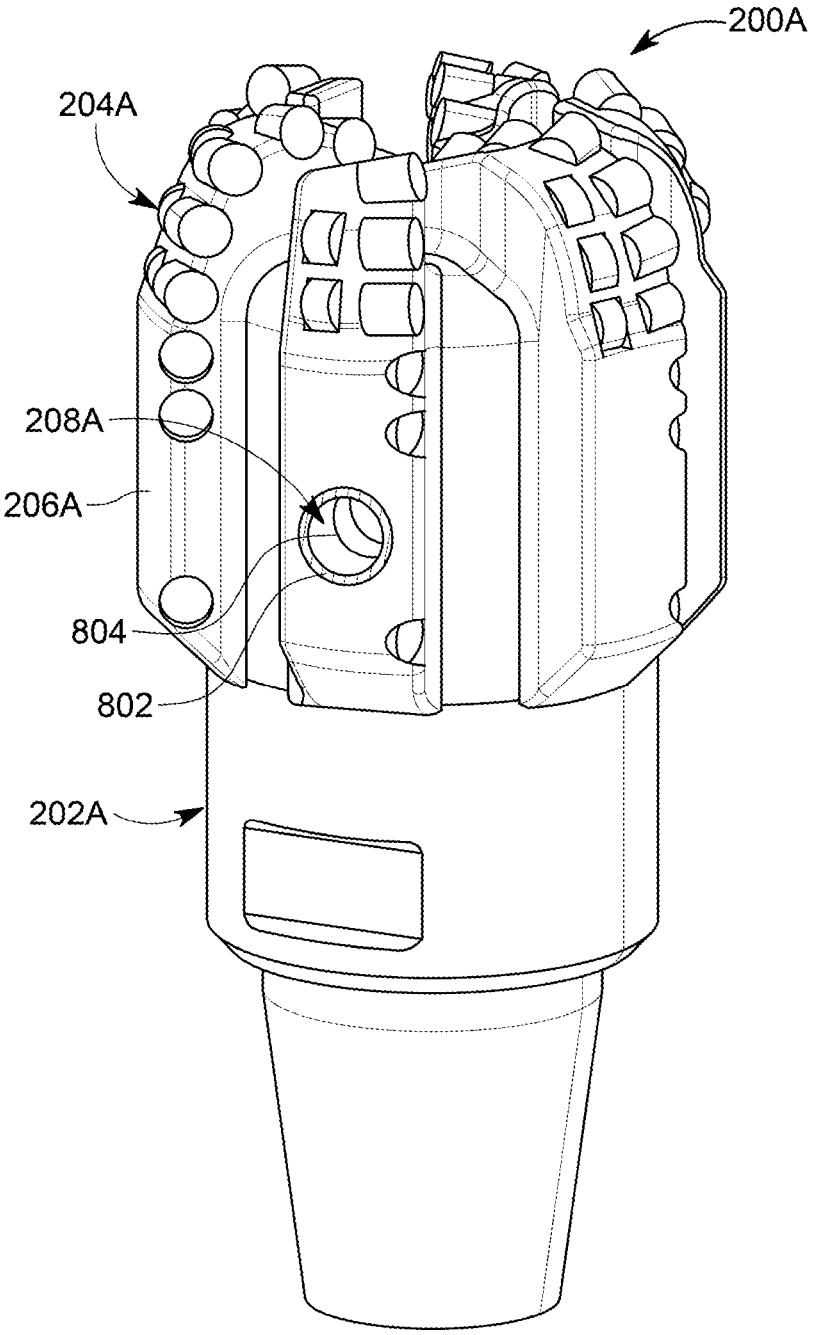
FIG. 8 illustrates a drill big having a hole made in one of its blades for receiving the continuous wear measuring device.

A continuous wear measuring device 300 having a resistive probe 304 is now discussed in more details with regard to FIGS. 8 to 13. FIG. 8 shows the drill bit 200A having a cavity 208A formed into the gauge region 206A of a blade 204A. The cavity may have a diameter of about 2.5 cm and a depth between 2.5 and 5.0 cm. In this embodiment, a sensor attachment 802 is placed in the cavity 208A and the continuous wear measuring device 300 is attached to the sensor attachment 802. While the sensor attachment 802 is fixed in place inside the blade of the drill bit or tool by, for example, brazing, or other high heat generating method, the continuous wear measuring device 300 is attached to the sensor attachment with a removable device, for example, an internal, circumferential groove 804 (or equivalent mechanism) so that the device 300 can be easily removed from the drill bit. The sensor attachment may be shaped as a cup and may be made of steel to protect the device 300.

Figure 9:
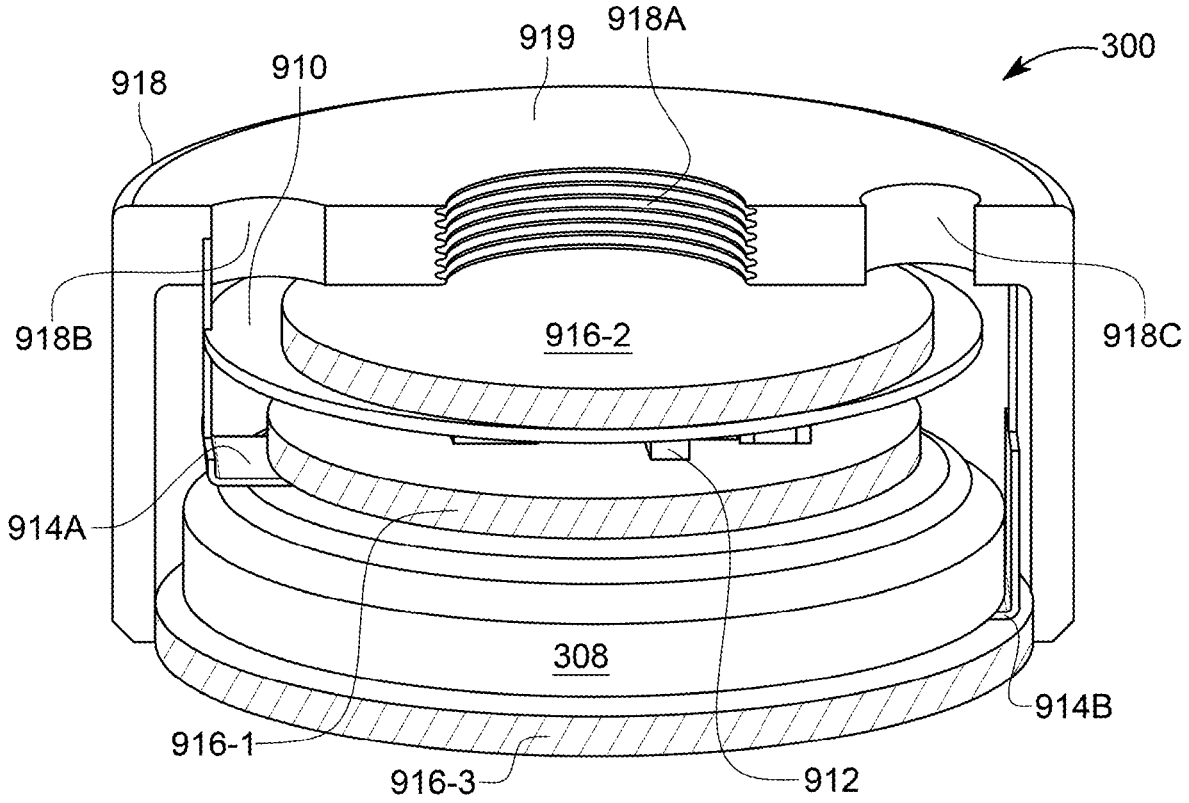
FIG. 9 illustrates the electronics associated with the continuous wear measuring device.

Part of the continuous wear measuring device 300 is illustrated in FIG. 9 and has a printed circuit board 910 that houses various electronic devices 912, for example, the control unit 306, the memory unit 312, and the communication system 310. The power supply 308 is attached with two wires 914A and 914B to the printed circuit board 910 as shown in the figure. The control unit is insulated from the power supply by an electrical insulator layer 916-1. Additional insulator layers 916-2 and 916-3 may be used to insulate the control unit and the power supply from an electronics housing 918 (note that the electronics housing is part of the housing 302). One of the insulator layers 916-3 may be mechanically attached to the bottom of the electronics housing 918 to close an end of the electronics housing 918. In this embodiment, the bottom of the electronics housing 918 is open. The top 919 of the electronics housing is partially closed. A hole 918A is formed in the top portion 919 of the electronics housing 918 for allowing a puller device to retrieve the device 300 when desired, as will be discussed later. The hole 918A may be a threaded hole. The top of the electronics housing may also have two holes 918B and 918C for allowing the wires 914A and 914B to exit the electronics housing.

Figure 10:
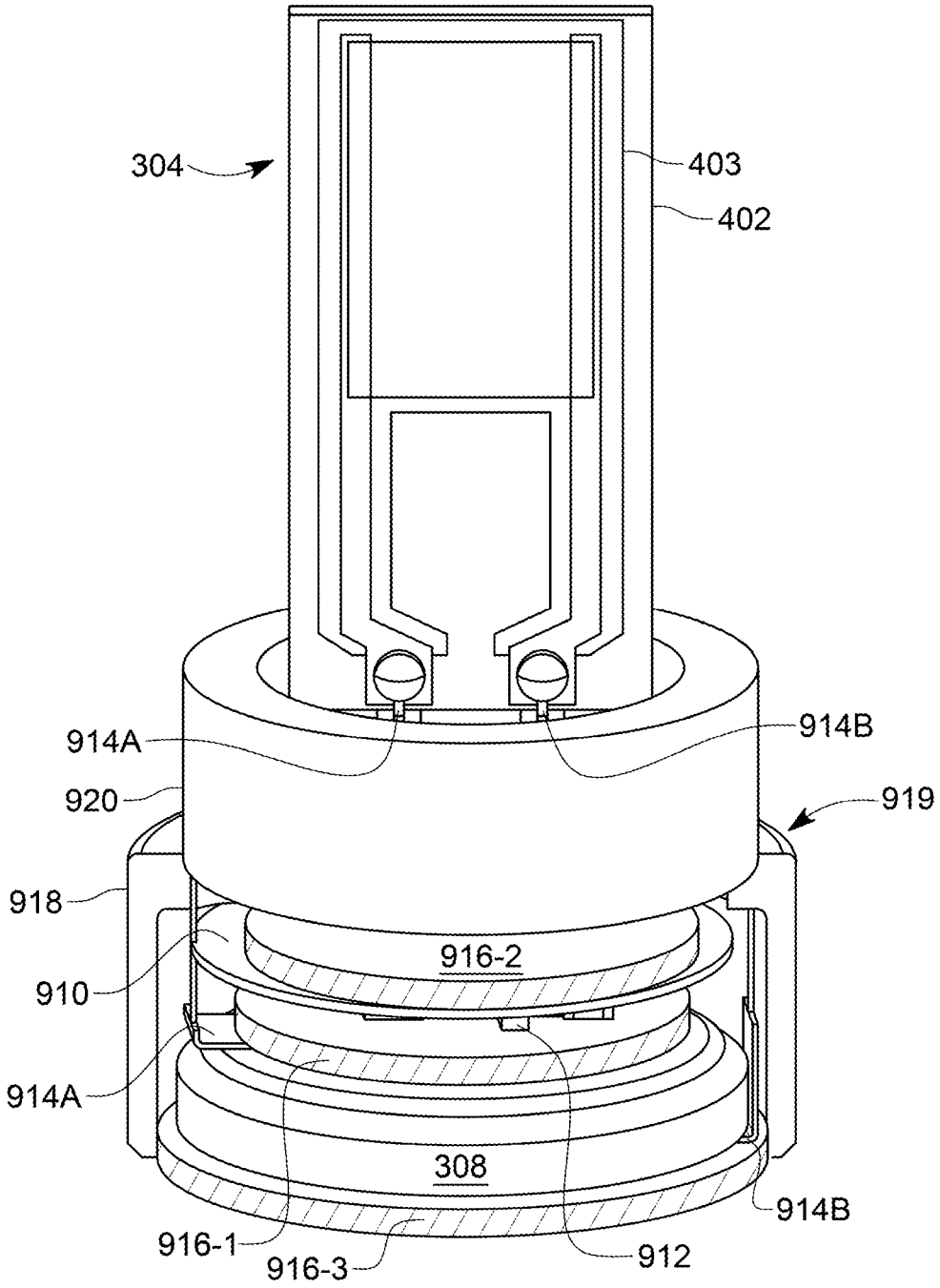
FIG. 10 illustrates the probe being attached to the electronics of the continuous wear measuring device.
Figure 11A:
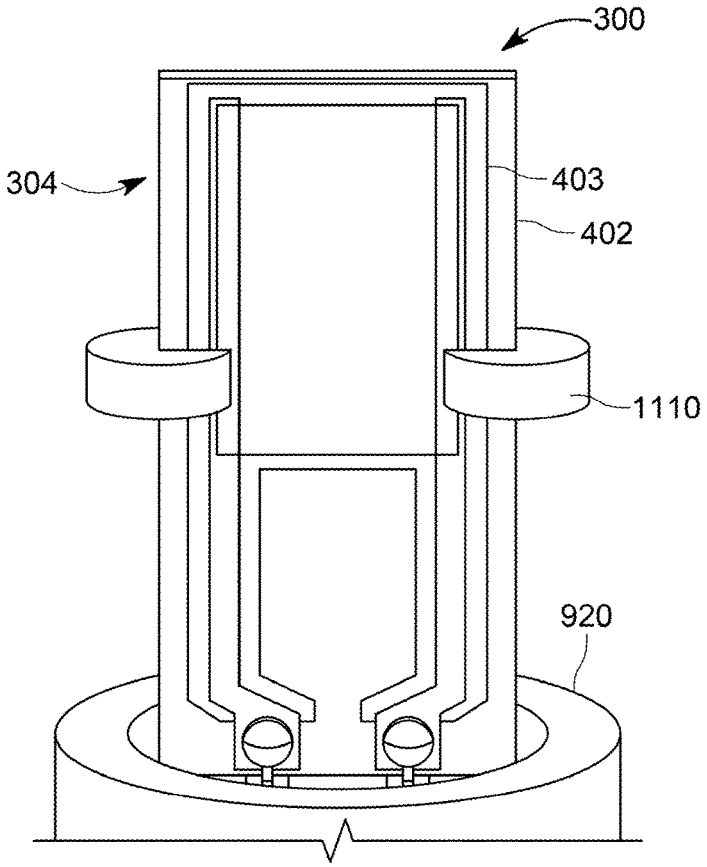
FIGS. 11A to 11C show a housing being attached to the electronics housing for protecting the probe.
Figure 11B:
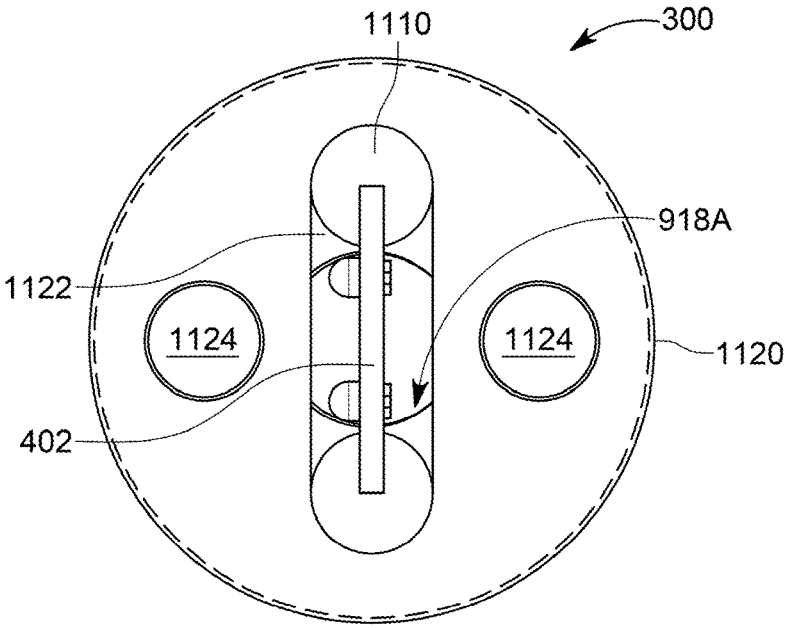
Figure 11C:
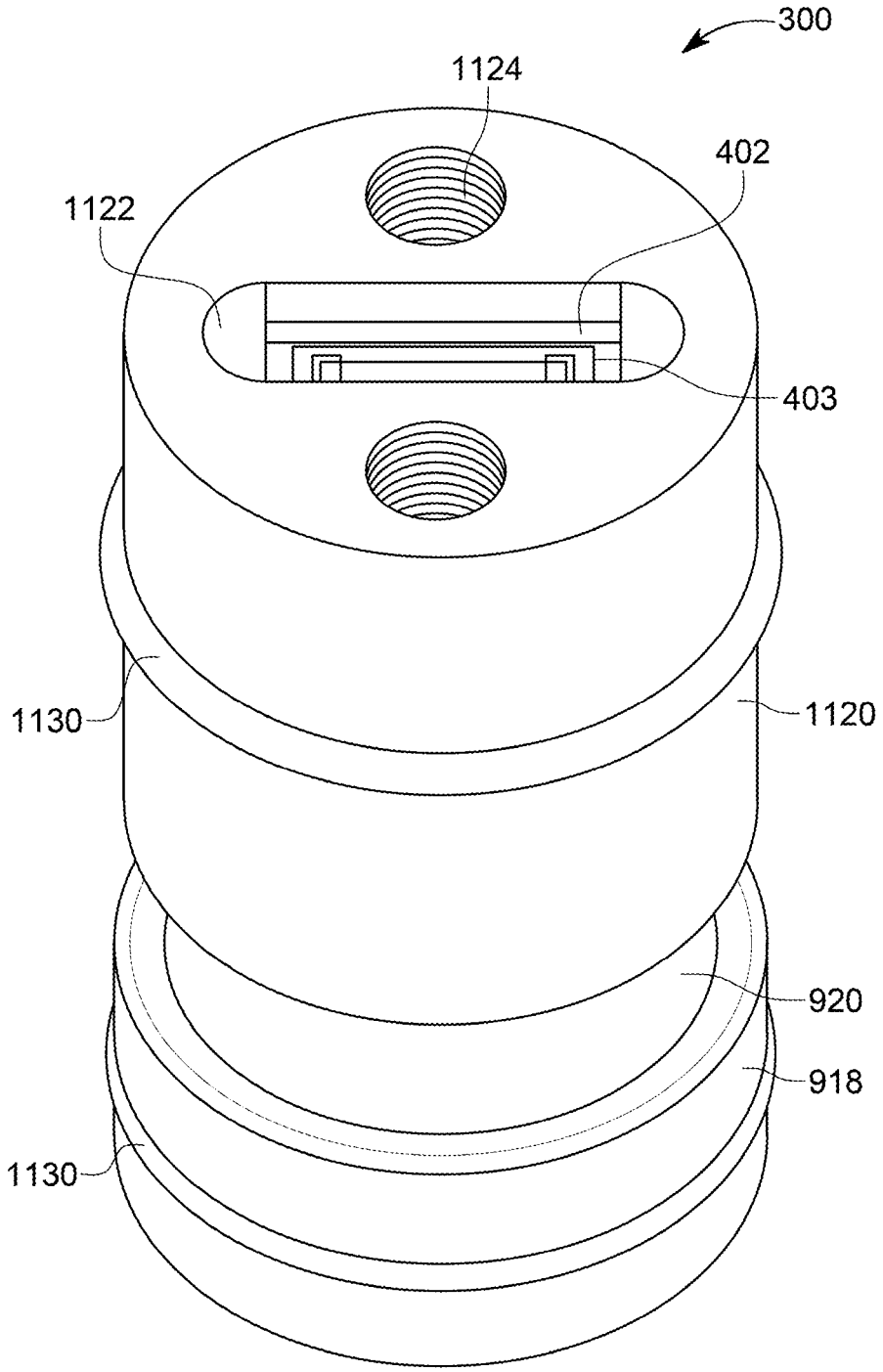

FIG. 10 shows the electronics housing 918 being provided with a spacer ring 920 over the top 919. A potting compound is then placed through the existing holes, e.g., 918A, 918B, or 918C to fill out the electronics housing. The potting compound protects the electronics from violent oscillations during the drilling process. The figure also shows the body 402 of the probe 304 being attached to the wires 914A and 914B, which protrude through the top 919. The wires 914A and 914B are electrically connected to the resistive elements 403, for example, by welding, with screws or with similar means. The wires 914A and 914B are tucked into the spacer ring 920. Next, resistor spacers 1110 are placed, as shown in FIG. 11A, around the body 402. These spacers protect the body 402 from violent oscillations when deployed within the drill bit. FIG. 11B shows a top view of device 300 with a probe (resistor in this case) enclosure 1120 placed over the body 402 to protect the resistors 403. The probe enclosure 1120 has a slit 1122 that extends through the entire enclosure. The body 402 of the probe extends through the slit 1122 so that the top of the probe enclosure 1120 and the top side of the body 402 are flush. Further, the spacers 1110 are sized to fit tightly inside the slot 1122 so that the body 402 cannot oscillate relative to the probe enclosure 1120. In this way, the top side of the body 402 will be in direct contact with the formation in the well when the drill bill is lowered into the well. The probe enclosure 1120 has a cylindrical shape, with the bottom end being opened and sized to tightly fit over the spacer ring 920. The top of the probe enclosure 1120 shows two threaded holes 1124 formed to receive a removal tool, as discussed later. FIG. 11C shows the probe enclosure 1120 added to the spacer ring 920. In one application, the probe enclosure 1120 is press fitted over the spacer ring 920 until the probe enclosure 1120 touches the electronics housing 918. In another application, the probe enclosure is press fitted over the electronics housing.

In yet another application, either the enclosure 1120 or the electronics housing 918 has a corresponding external, circumferential ridge 1130 that is sized to fit inside the groove 804 of the sensor attachment 802 shown in FIG. 8. Thus, the device 300 with the ridge 1130 and the sensor attachment 802 with the groove 804 form a kit that can be added to any well tool, either during the manufacturing of the well tool, or any other time after the manufacturing process. In one application, the resistor enclosure 1120 does not touch the electronics housing 918, so that the spacer ring 920 is visible. No matter which approach is taken, an epoxy resin is then injected inside the probe enclosure 1120, around the body 402, to fill the slot defined by the probe enclosure, so that the probe 304 does not oscillate inside the probe enclosure.

Figure 12:
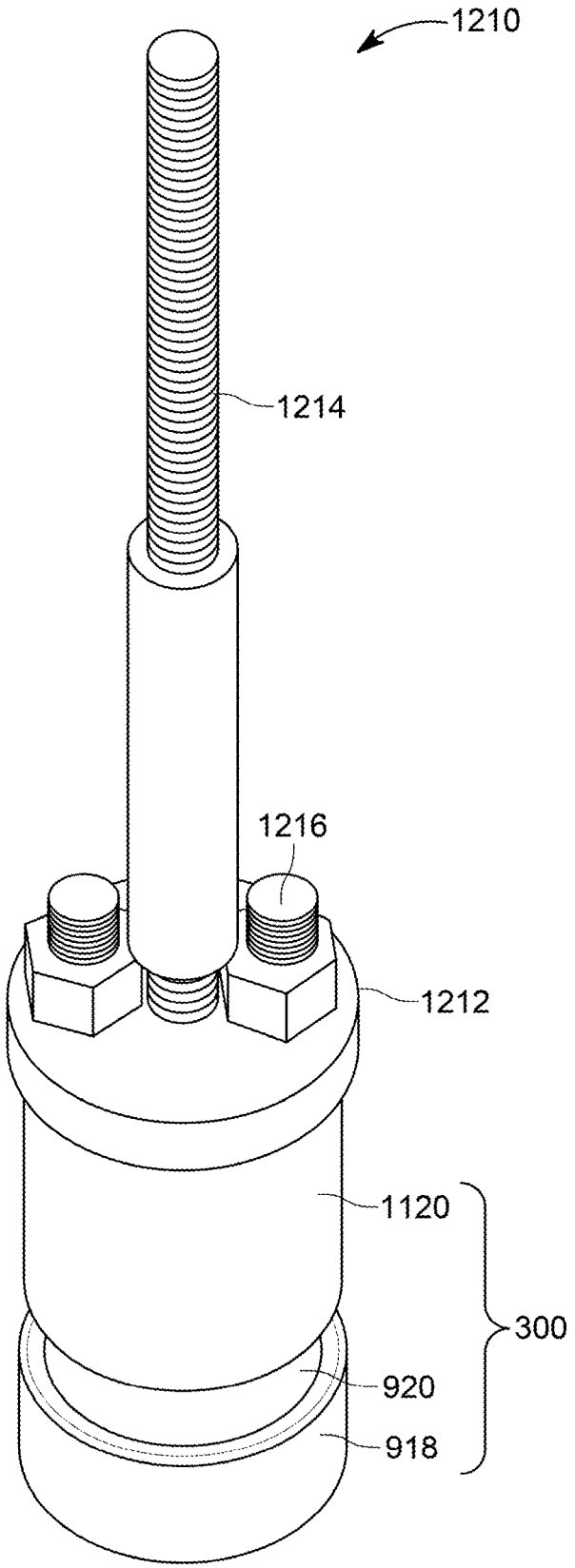
FIG. 12 illustrates a tool that is used to place or retrieve the continuous wear measuring device inside a corresponding hole in the well tool.
Figure 13:
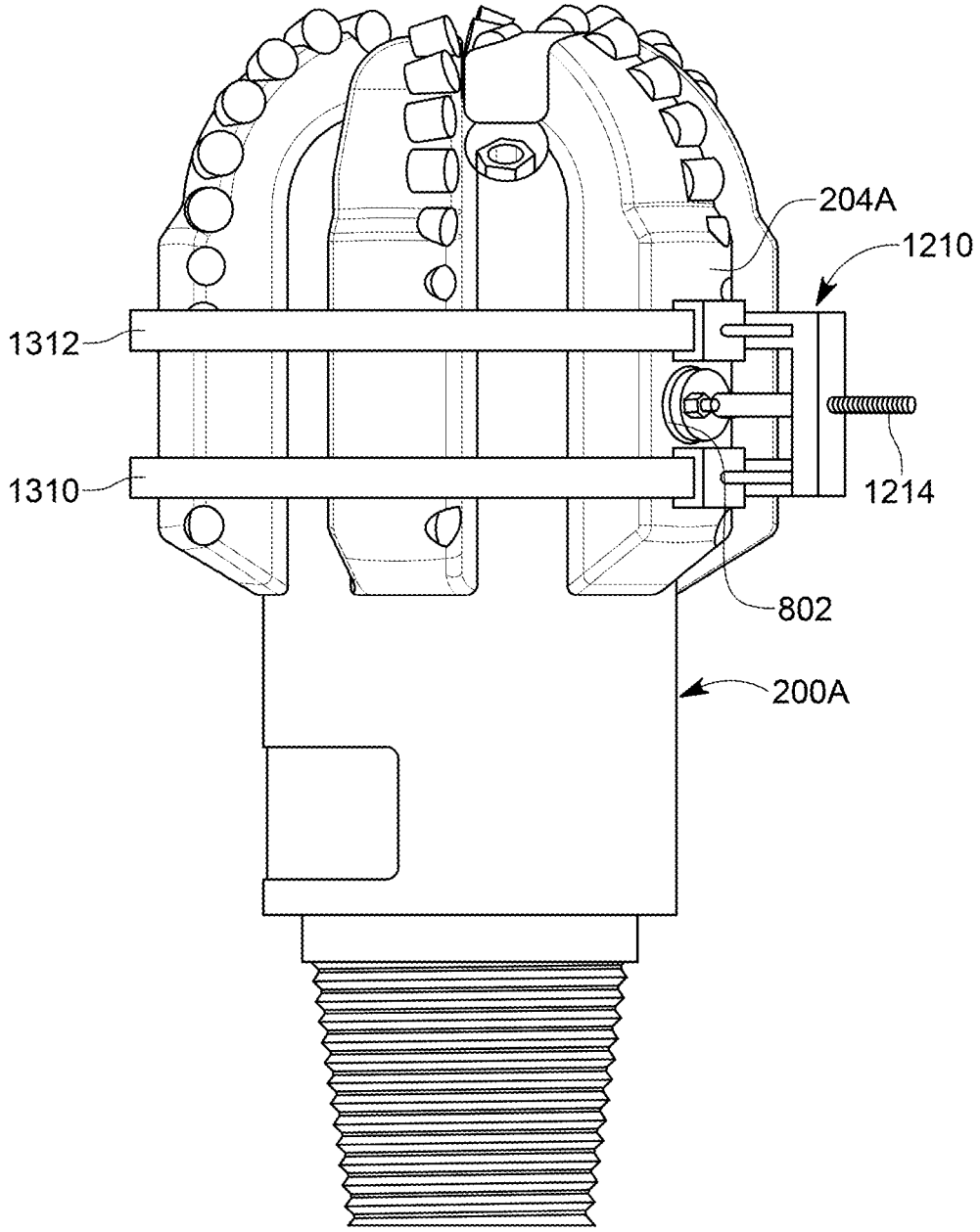
FIG. 13 illustrates the tool for placing or retrieving the continuous wear measuring device being attached to the drill bit.

FIG. 12 shows an insertion/retrieval tool 1210 that is used to insert or retrieve the device 300 from inside the corresponding cavity of the drill bit or tool. The insertion/retrieval tool 1210 has a plate 1212 with a threaded puller rod 1214 and the plate 1212 is attached to the threaded holes 1124 on the probe enclosure 1120 with corresponding bolts 1216. The insertion/retrieval tool 1210 can be attached to the drill bit with one or more clamps 1310 and 1312 as shown in FIG. 13, and then the threaded puller rod 1214 is actuated to either push the device 300 inside the corresponding sensor attachment 802 in the blade 204A or to retrieve the device 300 from the hole. In this embodiment, the device 300 is pressed into the sensor attachment 802 until a ridge 1130 formed on the electronics enclosure engages the corresponding groove 804. The puller rod 1214 is sized to engage the threads 918A of the electronics enclosure 918 so that the enclosure can be easily pulled out of the drill bit when required.

The disclosed embodiments provide a continuous wear measuring device that is configured to be attached to a gauge portion of a drill bit or tool in a well. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

REFERENCES

The entire content of all the publications listed herein is incorporated by reference in this patent application.

[1] U.S. Pat. No. 2,461,164.
[2] U.S. Pat. No. 2,580,860.
[3] U.S. Pat. No. 2,468,905.
[4] International Patent Application Publication WO 1999/028590.
[5] U.S. Pat. No. 2,582,312.
[6] U.S. Pat. No. 3,363,702.
[7] U.S. Pat. No. 2,657,909.
[8] U.S. Pat. No. 4,785,895.
[9] U.S. Pat. No. 6,250,295.
[10] U.S. Patent Application Publication No. 2010/0139987.

What is claimed is:

1. A continuous wear measuring device for measuring a wear in a well tool, the device comprising:

a probe configured to wear simultaneously with the well tool;

a probe enclosure configured to house the probe, the probe enclosure having a slot to expose the probe to a well in which the well tool is located;

a control unit electrically connected to the probe and configured to continuously measure a parameter of the probe; and an electronics housing configured to house the control unit and to contact the probe enclosure, wherein the control unit is configured to map a measured value of the parameter to a wear amount of the well tool, and wherein the probe enclosure and the electronics housing are configured to be inserted into a cavity of the well tool.

2. The device of claim 1, wherein the parameter is one of a resistance, capacitance or inductance and the well tool is a drill bit.

3. The device of claim 1, wherein the electronics housing and the probe enclosure form a housing of the device.

4. The device of claim 1, further comprising:

a power supply unit located within the electronics housing; and a first layer of insulator material sandwiched between the power supply and the control unit, wherein a top of the electronics housing includes a first hole through which a first wire of the power supply extends and connects to the probe, a second hole through which a second wire of the power supply extends and connects to the probe, and a third hole that is threaded.

5. The device of claim 4, further comprising:

a second layer of the insulator material being located between the control unit and a top of the electronics housing; and a third layer of the insulator material closing an open end of the electronics housing.

6. The device of claim 1, wherein a top of the slot is flush with a top of the probe.

7. The device of claim 6, wherein the probe comprises:

a body that holds a resistor or capacitor or inductor, wherein one of the resistor, capacitor or inductor extends throughout the slot.

8. The device of claim 7, further comprising:

a spacer ring located over the electronics housing and partially encircling the body of the probe.

9. The device of claim 7, further comprising:

one or more spacers attached to a body of the probe and fitting tightly inside the slot for preventing the probe to oscillate inside a probe enclosure.

10. The device of claim 1, further comprising:

a communication system configured for transmitting the measured value of the parameter to an operator of the well tool.

11. A well tool comprising:

a body having a blade, the blade being configured to remove material from a formation;

a sensor attachment fixed in a cavity formed in the blade; and a continuous wear measuring device for measuring a wear in the well tool, wherein the continuous wear measuring device is configured to be removably attached to an interior of the sensor attachment, and wherein the continuous wear measuring device is configured to wear simultaneously with the well tool and is configured to map a measured value of a parameter to a wear amount of the well tool.

12. The well tool of claim 11, wherein the continuous wear measuring device comprises:

a probe configured to wear simultaneously with the well tool; and a control unit electrically connected to the probe and configured to continuously measure the parameter of the probe.

13. The well tool of claim 12, wherein the parameter is one of a resistance, capacitance or inductance.

14. The well tool of claim 12, further comprising:

an electronics housing configured to house the control unit; and a probe enclosure configured to house the probe.

15. The well tool of claim 14, further comprising:

a power supply unit located within the electronics housing; and a first layer of insulator material sandwiched between the power supply and the control unit, wherein a top of the electronics housing includes a first hole through which a first wire of the power supply extends and connects to the probe, a second hole through which a second wire of the power supply extends and connects to the probe, and a third hole that is threaded.

16. The well tool of claim 15, further comprising:

a second layer of the insulator material being located between the control unit and a top of the electronics housing; and a third layer of the insulator material closing an open end of the electronics housing.

17. The well tool of claim 14, wherein the probe enclosure has a slot through which the probe extends and a top of the slot is flush with a top of the probe.

18. The well tool of claim 17, wherein the probe comprises:

a body that holds a resistor or capacitor or inductor, wherein one of the resistor, capacitor or inductor extends through the slot.

19. The well tool of claim 11, wherein the well tool is a drill bit.

20. A continuous wear measuring device kit comprising:

a sensor attachment having an internal, circumferential groove; and a continuous wear measuring device having an external, circumferential ridge that is sized to mate with the groove, wherein the sensor attachment is configured to be brazed inside a hole in a well tool, and wherein the continuous wear measuring device is configured to continuously measure a wear in the well tool as a probe of the continuous wear measuring device simultaneously wears with the well tool.

* * * * *